US005235827A

United States Patent [19]

Kiuchi et al.

[11] Patent Number: 5,235,827

[45] Date of Patent: Aug. 17, 1993

[54] CONTROL DEVICE FOR WASHING MACHINE

[75] Inventors: Mitsuyuki Kiuchi, Nara; Takeru Nakamura; Sadayuki Tamae, both of Toyonaka; Yoshiaki Sakita, Settsu, all of Japan

[73] Assignee: Matsushita Electric Industrial Co., Ltd., Osaka, Japan

[21] Appl. No.: 922,771

[22] Filed: Jul. 31, 1992

[51] Int. Cl.[5] ..... D06F 33/02

[52] U.S. Cl. ..... 68/12.04; 68/12.02; 68/12.05

[58] Field of Search ..... 68/12.02, 12.04, 12.05

[56] References Cited

U.S. PATENT DOCUMENTS 5,129,241 7/1992 Kiuchi et al. ..... 68/12.04
5,136,861 8/1992 Kiuchi et al. ..... 68/12.04

FOREIGN PATENT DOCUMENTS 2-077296 3/1990 Japan ..... 68/12.02
3-032699 2/1991 Japan ..... 68/12.04
3-94795 4/1991 Japan .
3-158192 7/1991 Japan .

*Primary Examiner*—Philip R. Coe
*Attorney, Agent, or Firm*—Wenderoth, Lind & Ponack

[57] ABSTRACT

A control device for a washing machine, comprising: a state detecting device for detecting a state of the washing machine, which includes a soil detecting member for detecting degree of soil of liquid in a tub of the washing machine, a quantity detecting member for detecting quantity of items to be washed and a liquid level detecting member for detecting liquid level in the tub; a control unit which receives a signal from the state detecting device so as to control washing, rinsing and hydro-extracting operations of the washing machine; and an operational condition changing device for changing an operational condition of the washing machine, which can be operated by a user; the control unit including control rule data for determining periods allocated to the washing, rinsing and hydro-extracting operations, respectively such that the control rule data is changed by operating the operational condition changing device.

6 Claims, 3 Drawing Sheets

CONTROL DEVICE FOR WASHING MACHINE

BACKGROUND OF THE INVENTION

The present invention generally relates to a washing machine for washing home clothing and more particularly, to a control device for the washing machine, which employs a microcomputer.

In recent years, development of sensor technology and control technology based on a microcomputer such as fuzzy control has enabled more sophisticated and optimum control of washing operation in accordance with soil and quantity of items to be washed. For example, Japanese Patent Laid-Open Publication No. 3-94795 (1991) proposes a washing machine in which washing period can be controlled in accordance with soil of washing liquid. However, in fuzzy control disclosed in this prior art document, an antecedent membership function indicative of magnitude of a signal from a sensor or a consequent membership function indicative of operational quantity to be subjected to fuzzy inference, such as washing period is determined by a designing engineer of the washing machine or experimentally. Thus, in case its user wishes to wash or rinse the items slightly longer than the preset period, the additional washing or rinsing period is set to a predetermined value through manual operation irrespective of a detection signal from the sensor.

SUMMARY OF THE INVENTION

Accordingly, an essential object of the present invention is to provide, with a view to eliminating the above mentioned inconveniences of conventional washing machines, a control device for a washing machine, which performs fuzzy control of washing operation on the basis of a signal from a sensor in accordance with its user's preference.

In order to accomplish this object of the present invention, a control device for a washing machine, according to the present invention includes a transparence detecting circuit for detecting soil of washing liquid, a quantity detecting circuit for detecting quantity of items to be washed, a liquid level detecting means for detecting liquid level in a washing tub, an operational display circuit to which preference of a user is inputted by keying and a control circuit for controlling operation of the washing machine in response to signals from the transparence detecting circuit, the quantity detecting circuit, the liquid level detecting circuit and the operational display circuit. The control circuit includes a fuzzy control unit which performs fuzzy inference on the basis of the signals from the transparence detecting circuit, the quantity detecting circuit and the liquid level detecting circuit so as to control operation of the washing machine such that a plurality of inference consequents of the fuzzy control unit are selected in accordance with preference of the user.

By this arrangement of the present invention, if the long, slightly long or short washing period is set by keying from the operational display circuit, a membership function of the fuzzy inference consequent can be so set as to be long, slightly long or short such that the washing period can be controlled in accordance with preference of the user. One of a plurality of the inference consequents for performing fuzzy control in response to the signals from the sensors can be selected such that washing or rinsing can be performed longer or shorter than a period preset by a designing engineer of the washing machine.

As described above, in the present invention, fuzzy control is performed in response to the signals from the transparence detecting circuit, the quantity detecting circuit and the liquid level detecting circuit and the inference consequents of fuzzy control are changed such that the washing period, quantity of rinsing water, hydro-extracting period, etc. are performed more or less than their preset values. Especially, by changing or selecting real number type membership functions of the consequents of rule tables of fuzzy inference, the washing period can be controlled so as to be increased, for example, only when soil of the washing liquid is intense. It is needless to say that the membership functions as a whole can be so set as to be long or the washing period is so set as to be long when soil of the washing liquid is slight with high transparent degree and short saturation period. Meanwhile, this similarly applies to not only the case where the rule table of the consequent of arithmetic operation for fuzzy inference is changed but the case where results of fuzzy inference are stored as tables such that the table having the long or short washing period can be selected by a look-up table procedure.

Furthermore, if an operational period can be set and stored by keying so as to be longer or shorter than the preset value for each of the washing, rinsing and hydro-extracting operations, an operational condition conforming further to preference of the user can be obtained.

Moreover, since the washing period is not determined by the user but the rule tables of fuzzy control are changed in accordance with the signals from the sensors, the washing machine can be operated in accordance with degree of soil of the washing liquid or degree of rinsing. Therefore, when soil of the washing liquid is slight or quantity of the items to be washed is small, quantity of washing water, washing period, quantity of rinsing water, etc. can be reduced, thereby resulting in great saving of water, power consumption and operating time.

BRIEF DESCRIPTION OF THE DRAWINGS

This object and features of the present invention will become apparent from the following description taken in conjunction with the preferred embodiment thereof with reference to the accompanying drawings, in which.

DETAILED DESCRIPTION OF THE DRAWINGS

Figure 1:
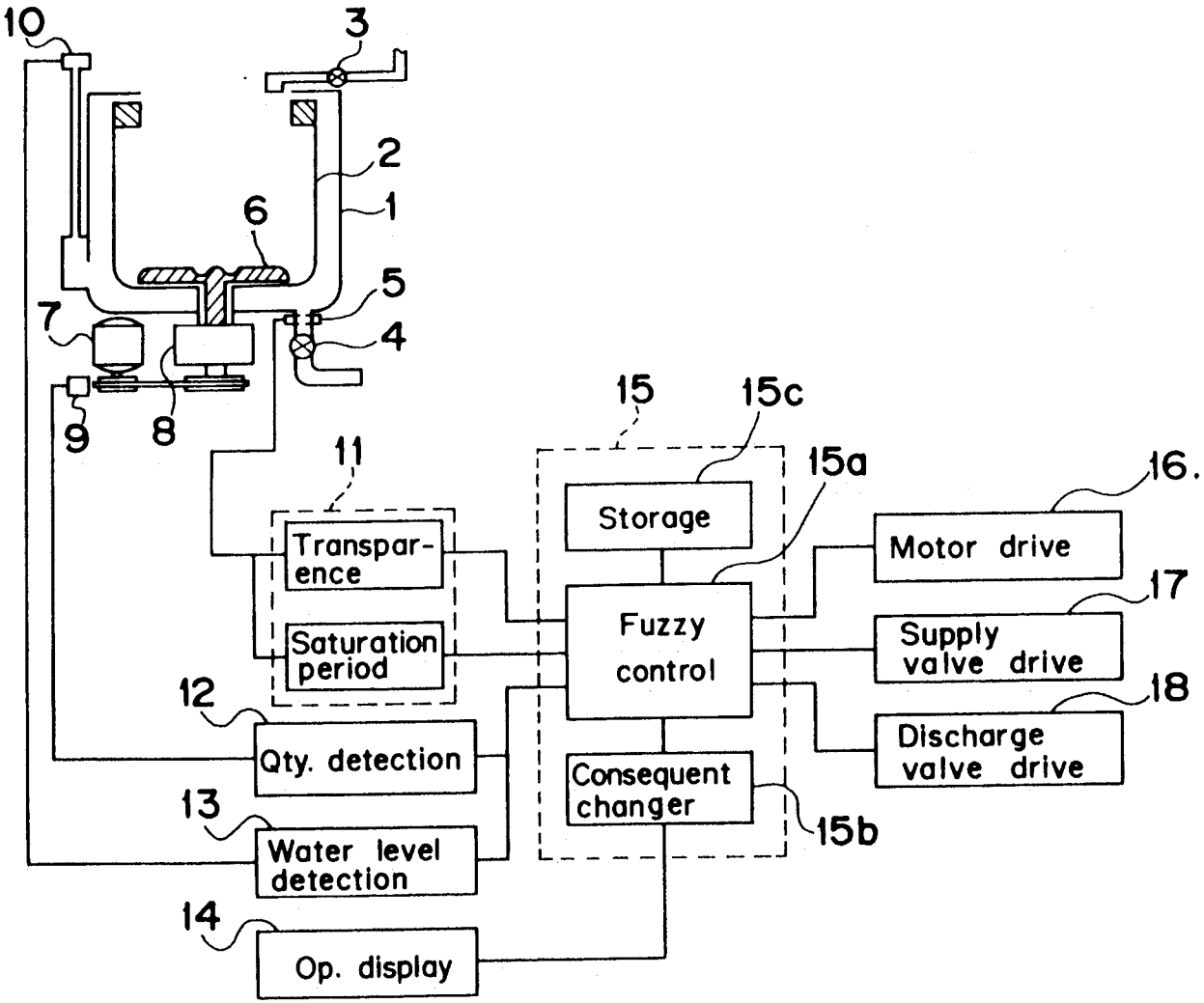
FIG. 1 is a block diagram of a control device for a washing machine, according to one embodiment of the present invention.

Referring now to the drawings, there is shown in FIG. 1, a control device for a washing machine, according to one embodiment of the present invention. In FIG. 1, the washing machine includes a water tub 1 in which a washing tub 2 is accommodated. Water is supplied to the washing tub 2 from a water supply valve 3, while washing liquid in the water tub 1 is discharged by a discharge valve 4 provided at a bottom portion of the water tub 1. A photosensor 5 constituted by a light emitting element and a light receiving element is attached to a discharge cock connecting the water tub 1 and the discharge valve 4 so as to detect transparent degree of the washing liquid. An agitating vane 6 is provided at a bottom portion of the washing tub 2 such that rotational force from a motor 7 is transmitted to the agitating vane 6 through a speed reduction mechanism 8. A rotational sensor 9 is provided for detecting inertial rotations of the motor 7 at the time when the motor 7 has been turned off during washing agitation of the agitating vane 6. A water level sensor 10 is provided for detecting water level in the washing tub 2.

The control device includes a transparence detecting circuit 11 for detecting transparent degree of the washing liquid. Light emitting output is controlled at the time when the washing liquid is clean such that soil of the washing liquid is detected on the basis of deviation of transparent degree of the washing liquid from that obtained at the time when the washing liquid is clean. Degree of soil of the washing liquid can be judged from a saturation period upon lapse of which transparent degree of the washing liquid is fixed and from deviation between transparent degree of the washing liquid obtained at the time of lapse of the saturation period and that obtained at the time when the washing liquid is clean.

The control device further includes a quantity detecting circuit 12 for detecting quantity of items to be washed from magnitude of the number of inertial rotations of the motor 7 at the time of agitation of the agitating vane 6, a water level detecting circuit 13 for detecting water level of the washing tub 2 from magnitude of a signal of the water level sensor 10 and an operational display circuit 14. The operational display circuit 14 enables an user to control operation of the washing machine through keying in accordance with the user's preference.

Moreover, the control device includes a control circuit 15. In response to signals from the sensors and operational setting by the user, the control circuit 15 controls a motor drive circuit 16, a water supply valve drive circuit 17 for driving the water supply valve 3 and a discharge valve drive circuit 18 for driving the discharge valve 4. The control circuit 15 includes a fuzzy control unit 15*a*, a consequent changer 15*b* and a storage 15*c*.

Figure 2:
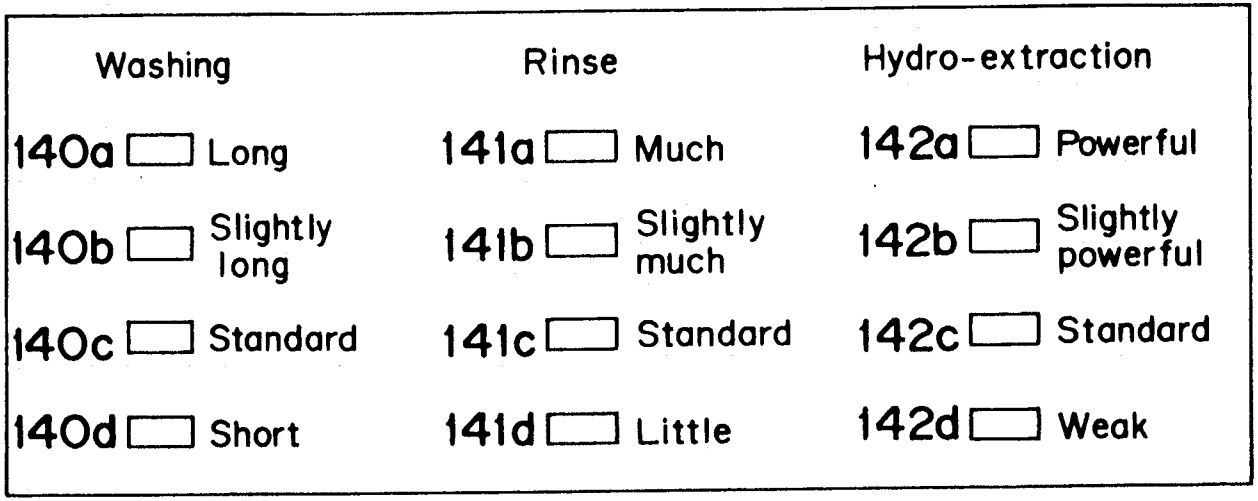
FIG. 2 is a front elevational view of an operational display of the washing machine of FIG. 1.

FIG. 2 shows an operational display of the washing machine of FIG. 1. In FIG. 2, display lamps 140*a*, 140*b*, 140*c* and 140*d* indicate long, slightly long, standard and short washing periods set selectively by the user, respectively, while display lamps 141*a*, 141*b*, 141*c* and 141*d* indicate long, slightly long, standard and short rinsing periods (or much, slightly much, standard and little rinsing water) set selectively by the user, respectively. Meanwhile, display lamps 142*a*, 142*b*, 142*c* and 142*d* indicate powerful, slightly powerful, standard and weak hydro-extraction set selectively by the user. For example, if the user has turned on the display lamp 140*a* indicative of the long washing period in the operational display, setting of a fuzzy inference consequent of the fuzzy control unit 15*a* is changed by the consequent changer 15*b* so as to select the long washing period and the fuzzy inference consequent subjected to setting change as described above is stored in the storage 15*c*.

Figure 3A:
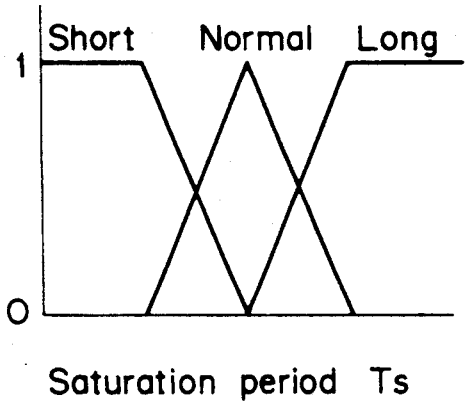
FIG. 3*a* and 3*b* are graphs showing membership functions of saturation period and transparent degree of washing liquid in the washing machine of FIG. 1, respectively.
Figure 3B:
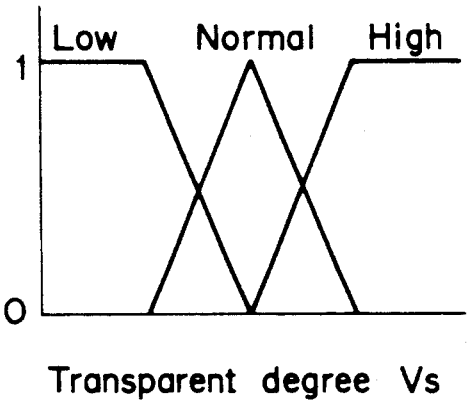

Regarding fuzzy inference of the fuzzy control unit 15*a*, FIGS. 3*a* and 3*b* show antecedent membership functions of saturation period Ts and transparent degree Vs obtained at the time of lapse of the saturation period Ts, which factors Ts and Vs are detected by the transparence detecting circuit 11. An antecedent membership function of quantity of the items to be washed is also required to be employed but is abbreviated for the sake of brevity.

TABLE 1

| | | Saturation period Ts | | |
|---|---|---|---|---|
| | | Short | Normal | Long |
| Transparent degree Vs | High | 3 | 6 | 9 |
| | Normal | 6 | 10 | 12 |
| | Low | 9 | 12 | 13 |

TABLE 2

| | | Saturation period Ts | | |
|---|---|---|---|---|
| | | Short | Normal | Long |
| Transparent degree Vs | High | 7 | 10 | 14 |
| | Normal | 10 | 16 | 16 |
| | Low | 14 | 16 | 18 |

Tables 1 and 2 above show consequent rule tables for saturation period Ts and transparent degree Vs in fuzzy inference of the fuzzy control unit 15*a*. Table 1 is a standard rule table, while Table 2 is a long rule table. Tables 1 and 2 are of real number type. For example, Table 1 shows that in case saturation period Ts is short and transparent degree Vs is high, soil of the washing liquid is slight and thus, the washing period is set to 3 min. Table 2 shows that the washing period is set to 7 min. under the saturation period Ts and transparent degree Vs are normal, the washing period is set to 10 min. and 16 min. in Tables 1 and 2, respectively.

If the real number type membership functions of the consequent rule tables of fuzzy inference are changed as described above, the washing period can be changed greatly. In addition, only one condition in the rule tables can also be changed. For example, the washing period can be increased only at an intensely soiled area.

Fuzzy inference method shown in Tables 1 and 2 is generally referred to as "Kanno's inference method" and detailed description of arithmetic operation of this inference method is abbreviated. This inference method has such a feature that since the consequent membership function is of real number type, storage capacity can be reduced, so that program capacity or running time of a microcomputer can be decreased.

Table 3 below is a rule table for fuzzy control of rinse based on quantity of the items to be washed and transparent degree of the washing liquid.

TABLE 3

| | | Quantity of items to be washed | | |
|---|---|---|---|---|
| | | Small | Medium | Large |
| Transparent degree | High | 1'-A (twice) | 1.5'-A (twice) | 2'-A (Twice) |
| | Normal | 1.5'-A (twice) | 2'-A (twice) | 2'-B, 2'-A |
| | Low | 1.5'-B, 2'-A | 2'-B, 2'-A | 2'-A (thrice) |

In Table 3, character A denotes rinse performed without replenishment of water, while character B denotes rinse performed through replenishment of water. For example, in Table 3, the indication "1'-A (twice)" (upper left end) means that 1-minute rinse without replenishment of water is performed twice, while the indication "1.5'-B, 2'-A" (lower left end) means that 1.5-minute rinse with replenishment of water and 2-minute rinse without replenishment of water are performed. If several kinds of such rule tables as Table 3 are stored so as to be selectively used by the user, various degrees of rinse can be controlled in accordance with the user's preference, transparent degree and quantity of the items to be washed.

The control circuit 15 may be adapted to control the washing and rinsing periods or the number of the rinsing operations and the hydro-extracting period on the basis of the saturation period Ts and the transparent degree Vs.

The control circuit 15 may also be adapted to determine intensity of flow of rinsing water on the basis of the saturation period Ts, the transparent degree Vs and the quantity of the items to be washed.

What is claimed

1. A control device for a washing machine, comprising:

a state detecting means for detecting a state of the washing machine, which includes a soil detecting means for detecting degree of soil of liquid in a tub of the washing machine, a quantity detecting means for detecting quantity of items to be washed and a liquid level detecting means for detecting liquid level in the tub;

a control means which receives a signal from said state detecting means so as to control washing, rinsing and hydro-extracting operations of the washing machine; and an operational condition changing means for changing an operational condition of the washing machine, which can be operated by a user;

said control means including control rule data for determining periods allocated to the washing, rinsing and hydro-extracting operations, respectively such that the control rule data is changed by operating said operational condition changing means.

2. A control device as claimed in claim 1, wherein said soil detecting means includes an optical detection circuit for detecting optical transparent degree of the liquid in the tub such that said control means controls the washing, rinsing and hydro-extracting operations in response to a signal from said optical detection circuit.

3. A control device as claimed in claim 2, wherein on the basis of a saturation period from a time point of start of the washing operation to a time point of saturation of the signal of said optical detection circuit and the optical transparent degree obtained at the time of saturation of the signal of said optical detection circuit, said control means controls the periods allocated to the washing and rinsing operations or the number of the rinsing operations and the period allocated to the hydro-extracting operation.

4. A control device as claimed in claim 3, wherein said control means determines intensity of flow of rinsing water on the basis of the saturation period and the optical transparent degree obtained by said optical detection circuit and the quantity of the items obtained by said quantity detecting means.

5. A control device as claimed in claim 1, wherein said control means is a fuzzy control means including a rule table for setting down control rules such that data of the rule table is changed by operating said operational condition changing means.

6. A control device as claimed in claim 5, wherein said control means stores a plurality of rule tables such that one of the rule tables is selected from the rule tables by operating said operational condition changing means.

* * * * *

UNITED STATES PATENT AND TRADEMARK OFFICE

CERTIFICATE OF CORRECTION

PATENT NO. : 5,235,827

DATED : August 17, 1993

INVENTOR(S) : Mitsuyuki Kiuchi

It is certified that error appears in the above-indentified patent and that said Letters Patent is hereby corrected as shown below:

On the cover page, between Items [21]and[51] add:
--[30] Foreign Application Priority Data August 5, 1991 [JP] ..... 3-185197--.

Signed and Sealed this

Twelfth Day of April, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,235,827

DATED : August 17, 1993

INVENTOR(S) : Mitsuyuki KIUCHI

It is certified that error appears in the above-indentified patent and that said Letters Patent is hereby corrected as shown below:

On the Title Page, between Items [22] and [51] add:
--[30] Foreign Application Priority Data
August 5, 1991 [JP] Japan.....3-195197--.

Signed and Sealed this

Tenth Day of May, 1994

Bruce Lehman

*Attest:*

BRUCE LEHMAN

*Attesting Officer*

*Commissioner of Patents and Trademarks*